US012674239B2

(12) United States Patent
Kim et al.

(10) Patent No.: US 12,674,239 B2
(45) Date of Patent: Jul. 7, 2026

(54) CHIRAL MAGNETIC NANOCOIL AND SYNTHESIS METHODS THEREOF

(71) Applicants: Korea University Research and Business Foundation, Seoul (KR); KOREA INSTITUTE OF SCIENCE AND TECHNOLOGY, Seoul (KR); Seoul National University R&DB Foundation, Seoul (KR)

(72) Inventors: Young Keun Kim, Seoul (KR); Yoo Sang Jeon, Seoul (KR); Eunjin Jeong, Seoul (KR); Sung Jong Yoo, Seoul (KR); Ki Tae Nam, Seoul (KR); Sang Won Im, Seoul (KR)

(73) Assignees: Korea University Research and Business Foundation, Seoul (KR); KOREA INSTITUTE OF SCIENCE AND TECHNOLOGY, Seoul (KR); Seoul National University R&DB Foundation, Seoul (KR)

( * ) Notice: Subject to any disclaimer, the term of this patent is extended or adjusted under 35 U.S.C. 154(b) by 11 days.

(21) Appl. No.: 18/390,703

(22) Filed: Dec. 20, 2023

(65) Prior Publication Data

US 2024/0254636 A1 Aug. 1, 2024

(30) Foreign Application Priority Data

Jan. 30, 2023 (KR) ..... 10-2023-0011456

(51) Int. Cl.
*C25B 3/13* (2021.01)

(52) U.S. Cl.
CPC ..... *C25B 3/13* (2021.01)

(58) Field of Classification Search
CPC ..... B82B 1/00
See application file for complete search history.

(56) References Cited

U.S. PATENT DOCUMENTS 5,635,515 A * 6/1997 Chauffert ..... A61P 35/00 514/305

FOREIGN PATENT DOCUMENTS

CN 108031834 B 7/2019
CN 114082971 A 2/2022
(Continued)

OTHER PUBLICATIONS

Moon et al. (Inorganic Hollow Nanocoils Fabricated by Controlled Interfacial Reaction and Their Electrocatalytic Properties, Small 2021, 17, 2103575) (Year: 2021).*
(Continued)

*Primary Examiner* — Alexandre F Ferre
(74) *Attorney, Agent, or Firm* — NSIP Law

(57) ABSTRACT

Disclosed herein is a technique for synthesizing chiral magnetic nanocoils using an electrodeposition technique, which can be used to fabricate magnetic nanosensors capable of generating an electric field by strongly reacting to an external magnetic field, such as Faraday's law of electromagnetic induction at the nanoscale, depending on the coil shape of the nanostructure. In accordance with one embodiment, a method of synthesizing a chiral magnetic nanocoil may include generating a primary particle composed of metal ions by applying an external electric field, binding a chiral molecule to a surface of the generated primary particle, and controlling an assembly direction of a next primary particle by the bound chiral molecule.

10 Claims, 20 Drawing Sheets

(56) References Cited

FOREIGN PATENT DOCUMENTS

| | | | |
|---|---|---|---|
| CN | 114905049 | B | 6/2023 |
| EP | 1 661 648 | A1 | 5/2006 |
| JP | 2005-298891 | A | 10/2005 |
| JP | 2018-193607 | A | 12/2018 |
| KR | 10-1711888 | B1 | 3/2017 |
| KR | 10-1916588 | B1 | 11/2018 |
| KR | 10-1967213 | B1 | 4/2019 |
| KR | 10-2021-0057670 | A | 5/2021 |
| WO | WO 2010/114490 | A1 | 10/2010 |

OTHER PUBLICATIONS

Remote Control of Time-Regulated Stretching of Ligand-Presenting Nanocoils In Situ Regulates the Cyclic Adhesion and Differentiation of Stem Cells, Adv. Mater. 2021, 33, 2008353). (Year: 2021).*

Wattanakit, Chularat, and Alexander Kuhn. "Encoding Chiral Molecular Information in Metal Structures." Chemistry—A European Journal 26.14 (2020): 2993-3003.

Kim, Hyeohn, et al. "γ-Glutamylcysteine-and Cysteinylglycine-Directed Growth of Chiral Gold Nanoparticles and their Crystallographic Analysis." Angewandte Chemie 132.31 (2020): (8 pages).

Jeon, Yoo Sang, et al. "Engineering the shape of one-dimensional metallic nanostructures via nanopore electrochemistry." Nano Today 42 (2022): 101348, (9 pages).

Extended European search report issued on Jul. 4, 2024, in counterpart European Patent Application No. 24153637.4 (11 pages).

Kim, Hyeohn, et al., "γ-Glutamylcysteine-and Cysteinylglycine-Directed Growth of Chiral Gold Nanoparticles and their Crystallographic Analysis", Angewandte Chemie, 2020, (8 Pages in English).

Japanese Office Action Issued on Apr. 8, 2025, in Counterpart Japanese Patent Application No. 2023-219797 (6 Pages in English, 7 pages in Japanese).

Japanese Office Action Issued on Nov. 11, 2025, in Counterpart Japanese Patent Application No. 2023-219797 (4 Pages in English, 4 Pages in Japanese).

* cited by examiner

CHIRAL MAGNETIC NANOCOIL AND SYNTHESIS METHODS THEREOF

CROSS-REFERENCE TO RELATED APPLICATION

This application claims priority to and the benefit of Korean Patent Application No. 2023-0011456, filed on Jan. 30, 2023, the disclosure of which is incorporated herein by reference in its entirety.

BACKGROUND

1. Field of the Invention

The present disclosure relates to a technique for synthesizing chiral magnetic nanocoils using an electrodeposition technique, which can be used to fabricate magnetic nanosensors capable of generating an electric field by strongly reacting to an external magnetic field, such as Faraday's law of electromagnetic induction at the nanoscale, depending on the coil shape of the nanostructure.

2. Description of the Related Art

Chirality refers to the property of a substance having a mirror image symmetrical structure that does not overlap by rotation or parallel movement.

By applying this property to nanomaterials, new physical, chemical, and optical properties are achieved, which can be applied to various fields such as catalysis, sensors, biochemistry, and spintronics.

In particular, chiral metal nanomaterials with magnetic properties are highly valuable because they respond to external magnetic fields.

However, the current technology for chiralization of magnetic metal inorganic nanomaterials has been limited by the complexity, stability, and efficiency of manufacturing methods.

Therefore, there is a need for a nanostructure synthesis method that can overcome these problems, as well as a technology to verify whether the nanostructure can actually produce a chiral magnetic effect under an external magnetic field at the nanoscale.

Conventional synthesis of chiral nanomaterials has been recognized as a challenge to be applied to various materials. In particular, synthesis methods for chiral nanomaterials based on 3d transition metal materials with magnetic properties are even more limited.

PRIOR ART LITERATURE

Patent Documents (Patent Reference 1) Korean Patent No. 10-1916588 titled "Metal Nano-spring and Manufacturing Method of the Same"

(Patent Reference 2) Korean Patent No. 10-1711888 titled "Metallic Nanotube and Preparation Method Thereof"

(Patent reference 3) Korean Patent No. 10-1967213 titled "Method of Manufacturing Magnetic Porous Membrane"

SUMMARY OF THE DISCLOSURE

Therefore, the present disclosure has been made in view of the above problems, and it is an object of the present disclosure to provide a method of manufacturing chiral magnetic nanocoils in large quantities using an electrodeposition method that provides ease of synthesis, high stability, and is economical, eco-friendly, and advantageous for large-scale synthesis.

In accordance with the present disclosure, the above and other objects can be accomplished by the provision of a method of synthesizing a chiral magnetic nanocoil. The method may include generating a primary particle composed of metal ions by applying an external electric field, binding a chiral molecule to a surface of the generated primary particle, and controlling an assembly direction of a next primary particle by the bound chiral molecule.

In one embodiment, the method may further include controlling an influence of the chiral molecule by adjusting at least one of an intensity of the external electric field, a concentration of metal ion precursors and additives, or a concentration of the chiral molecule.

In one embodiment, the binding of the chiral molecule to the surface of the generated primary particle may include binding, as the chiral molecule, cinchonine ($C_{19}H_{22}N_2O \cdot ½H_2SO_4$) as a chiral modifier of a first orientation.

In one embodiment, the binding of the cinchonine as the chiral modifier of the first orientation may include binding $C_{19}H_{22}N_2O \cdot ½H_2SO_4$) of a concentration within a selected range as the chiral modifier of the first orientation.

In one embodiment, the binding of the chiral molecule to the surface of the generated primary particle may include binding, as the chiral molecule, cinchonidine ($C_{19}H_{22}N_2O$) as a chiral modifier of a second orientation.

In one embodiment, the binding of the cinchonidine as the chiral modifier of the second orientation may include $C_{19}H_{22}N_2O$ of a concentration within a selected range as the chiral modifier of the second orientation.

In one embodiment, according to the method, when the concentration of the metal ions is 50-200 mM based on the AAO template having a size of one nanopore of 200 nm in diameter and 60 μm in height, the concentration of the chiral modifier of the first orientation or the second orientation may be designed in a range of [helical modifier]:[chiral modifier]=60-80 mM:5-50 μM (1200-16000:1)

In one embodiment, the binding of the chiral molecule to the surface of the generated primary particle may include adding a chiral modifier of a first orientation or a chiral modifier of a second orientation to a solution containing a metal precursor and at least one additive, adjusting pH of the solution to 1.0 to 3.0 by adding a small amount of acid, and filling and electrodepositing a nanopore template with the solution.

BRIEF DESCRIPTION OF THE DRAWINGS

The above and other objects, features and other advantages of the pre sent disclosure will be more clearly understood from the following detailed description taken in conjunction with the accompanying drawings, in which.

DETAILED DESCRIPTION OF THE DISCLOSURE

Figure 1:
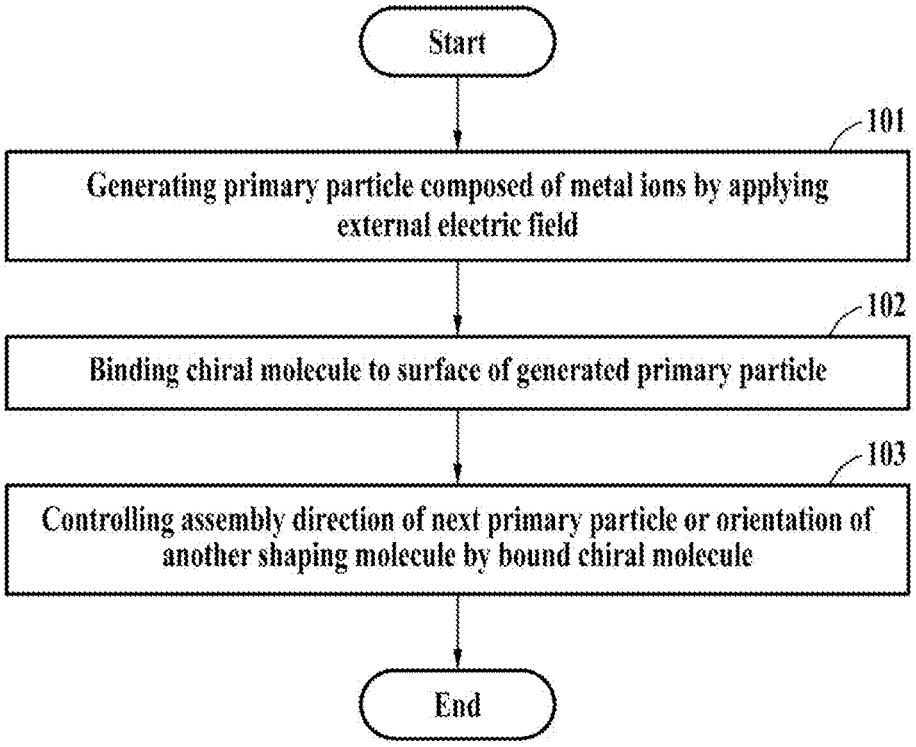
FIG. 1 is a diagram illustrating a manufacturing method for chiral magnetic nanocoils according to one embodiment.

Any specific structural or functional descriptions of embodiments according to the concepts of the invention disclosed herein are illustrative only for the purpose of describing embodiments according to the present inventive concept, and embodiments according to the present inventive concept may be practiced in various forms and are not limited to the embodiments described herein.

Since embodiments according to the present inventive concept are subject to various modifications and can take various forms, embodiments will be described in detail herein with reference to the accompanying drawings. However, this is not intended to limit the embodiments according to the present inventive concept to any particular disclosed forms, and includes modifications, equivalents, or substitutions that are within the spirit and scope of the present disclosure.

Terms such as first or second may be used to describe various components, but the components are not to be limited by such terms. These terms are used only to distinguish one component from another. For example, without departing from the scope of the present inventive concept, a first component may be named as a second component, and similarly, a second component may be named as a first component.

When a component is referred to as being "connected" or "coupled" to another component, it is to be understood that it may be directly connected or coupled to the other component, but that there may be other components between the components. On the other hand, when a component is referred to as being "directly connected" or "directly coupled" to another component, it is to be understood that there are no other components between the components. Expressions that describe relationships between components, such as "between" and "directly between" or "directly adjacent to" should also be interpreted in the same manner.

The terminology employed in the present disclosure is merely used to describe specific embodiments and is not intended to limit the present disclosure. A singular expression includes a plural expression unless the context clearly dictates otherwise. In the present disclosure, the term "include" or "have" is intended to indicate that characteristics, figures, steps, operations, constituents, and components disclosed in the specification or combinations thereof exist. The term "include" or "have" should be understood as not pre-excluding possibility of existence or addition of one or more other characteristics, figures, steps, operations, constituents, components, or combinations thereof.

Unless defined otherwise, all terms used herein, including technical or scientific terms, have the same meaning as commonly understood by one of ordinary skill in the art to which this invention belongs. Terms such as those defined in commonly used dictionaries should be interpreted as having a meaning that is consistent with their meaning in the context of the present disclosure and the relevant art and will not be interpreted in an idealized or overly formal sense unless expressly so defined herein.

Hereinafter, embodiments will be described in detail with reference to the accompanying drawings. However, it should be noted that the scope of the patent application is not limited or defined by these embodiments. Like reference numerals in each drawing designate like members.

FIG. 1 is a diagram illustrating a manufacturing method for chiral magnetic nanocoils according to one embodiment.

The present disclosure provides a method of manufacturing chiral magnetic nanocoils in large quantities using an electrodeposition method that provides ease of synthesis, high stability, and is economical, eco-friendly, and advantageous for large-scale synthesis.

To this end, a method of manufacturing chiral magnetic nanocoils according to one embodiment may include generating a primary particle composed of metal ions by applying an external electric field (step 101).

Recent research has shown that by controlling additives and the density of current applied during synthesis, different shapes of nanostructures, such as nanotubes and nanocoils, may be prepared within a nanopore template, and these nanostructures may be prepared in such a way that primary particles are assembled by a mechanism.

For the metal precursor solution containing the metal ions, any metal ion can be used, but those derived from transition metal oxides containing transition metals such as nickel (Ni), cobalt (Co), iron (Fe), and chromium (Cr) are more preferable in terms of electrical, magnetic, and thermal conductivity. In the metal precursor solution, the metal ions may be derived from transition metals, precious metals, and rare earth metals. The transition metal may be Fe, Co, or Ni. The precious metal may be gold (Au), platinum (Pt), palladium (Pd), or silver (Ag). The rare earth metal may be neodymium (Nd), samarium (Sm), gadolinium (Gd), or various alloys made from two or more of these metals.

Various metal precursors as well as the 3d transition metal, which is a representative magnetic material, are highly soluble in water, and thus are very advantageous for use in the preparation of nanomaterials based on electrodeposition.

Next, the method of manufacturing chiral magnetic nanocoils according to one embodiment may include binding a chiral molecule to the surface of the generated primary particle (step 102).

In the present disclosure, the process of forming the shape of the chiral nanocoil is different from the general plating method, in that, when an external electric field is applied, a primary molecule composed of metal ions is first generated, and the chiral molecules bind to the metal surface, thereby controlling the assembly direction of the next primary particle or the orientation of other chiral molecules.

At this time, different chiral molecules have different binding strengths to metal ions, metal surfaces, helical modifier (helical shaping molecules), etc., and therefore, selecting appropriate chiral molecules may be a key strategy for the synthesis of chiral magnetic nanocoils.

In addition, the influence of chiral molecules in the process of assembly between primary particles may be controlled by the strength of the external electric field, the concentration of metal ion precursors and additives, or the concentration of chiral molecules.

For the influence of the chiral molecules, the method of manufacturing chiral magnetic nanocoils according to one embodiment may include controlling the influence of the chiral molecules by controlling at least one of the strength of the external electric field, the concentration of metal ion precursors and additives, or the concentration of chiral molecules.

Furthermore, the method of manufacturing chiral magnetic nanocoils according to one embodiment may include binding cinchonine, which is a chiral molecule, as a chiral modifier in the first orientation in order to bind the chiral molecule to the surface of the generated primary particle.

For example, the method of manufacturing chiral magnetic nanocoils according to one embodiment may include binding 0.01 mM of $C_{19}H_{22}N_2O \cdot \frac{1}{2}H_2SO_4$ as a chiral modifier in the first orientation to bind cinchonine as the chiral modifier in the first orientation.

The method of manufacturing chiral magnetic nanocoils according to one embodiment may include binding cinchonidine, which is a chiral molecule, as a second chiral modifier in order to bind the chiral molecule to the surface of the generated primary particle. In particular, 0.01 mM of $C_{19}H_{22}N_2O$ may be bound as a chiral modifier in a second orientation to bind cinchonidine as the chiral modifier in the second orientation.

In addition to cinchonine and cinchonidine, various modifiers may be used as chiral molecules. For example, modifiers such as quinine/quinidine and L-/D-Histidine may be used.

For example, the concentration of chiral modifiers may be designed considering the volume ratio of the anodic aluminum oxide (AAO) template and the concentration of metal ions.

Based on a currently employed AAO template with a nanopore size of 200 nm in diameter and 60 μm in height, when the concentration of metal ions is 50-200 mM, a chiral magnetic nanocoil may be designed in the range of [helical modifier]:[chiral modifier]=60-80 mM:5-50 μM (1200-16000:1).

In particular, even if the diameter and height of the AAO template are varied, chiral magnetic nanocoils may be synthesized by controlling the concentration of metal ions, additives (helical modifier), and chiral molecules according to the ratio of volume of the corresponding cylindrical nanopore template.

In other words, even if the template is not 200 nm in diameter and 60 μm in height, chiral nanocoils can be synthesized if the ratio corresponding to [helical modifier]:[chiral modifier] is properly adjusted.

For example, when the height of the template is reduced from 60 to 30 μm, the proportion of precursor solution filled inside the pores is reduced by ½ due to the decrease in the volume of the pore template, and therefore, chiral magnetic nanocoils may be synthesized by reducing the concentration of metal ions, additives (helical modifier), and chiral molecules to about half of the concentration range described above.

On the other hand, when the diameter of the AAO template is 200 nm and the height of the AAO template is 60 μm (which is the AAO specification commonly used for nanocoil synthesis), the standard condition under which nanocoils are synthesized is [Co, Fe, $VO^{2+}$, LAA]=80, 80, 60, 60 mM. When the diameter of the AAO template is 200 nm and the height of the AAO template is 15 μm, nanocoils may be synthesized under the condition of [Co, Fe, $VO^{2+}$, LAA]=20, 20, 15, 15 mM (when the area of the AAO pore wall becomes ¼).

Furthermore, by adjusting the required precursor and additive concentrations according to the ratio of the area of the wall surface of the AAO template through which current can flow during electrodeposition as described above, magnetic nanocoils can be synthesized by calculating the concentration ratio per area even if the specification of the AAO is varied.

Therefore, when the specification of one AAO pore template is within the range of 70 to 300 nm in diameter and 10 to 100 μm in height, chiral magnetic nanocoils may be synthesized by adjusting the concentration of metal ions and additives in the precursor solution according to the ratio.

In order to bind chiral molecules to the surface of the generated primary particles, the method of manufacturing chiral magnetic nanocoils according to one embodiment includes adding a chiral modifier in a first orientation or a chiral modifier in a second orientation to a solution containing a metal precursor and at least one additive, adjusting the pH of the solution to 1.0 to 3.0 by adding a small amount of acid, and filling the nanopore template for electrodeposition.

The present disclosure is not only the first example of the synthesis of chiral nanostructures using electrodeposition according to the foregoing description, but is also expected to be of great value as a main method for the mass synthesis of chiral magnetic nanostructures.

The method of manufacturing chiral magnetic nanocoils according to one embodiment may also include controlling the assembly direction of the next primary particle by the bound chiral molecule (step 103).

FIGS. 2A to 2I illustrate embodiments for synthesizing chiral magnetic nanocoils.

Figure 2A:
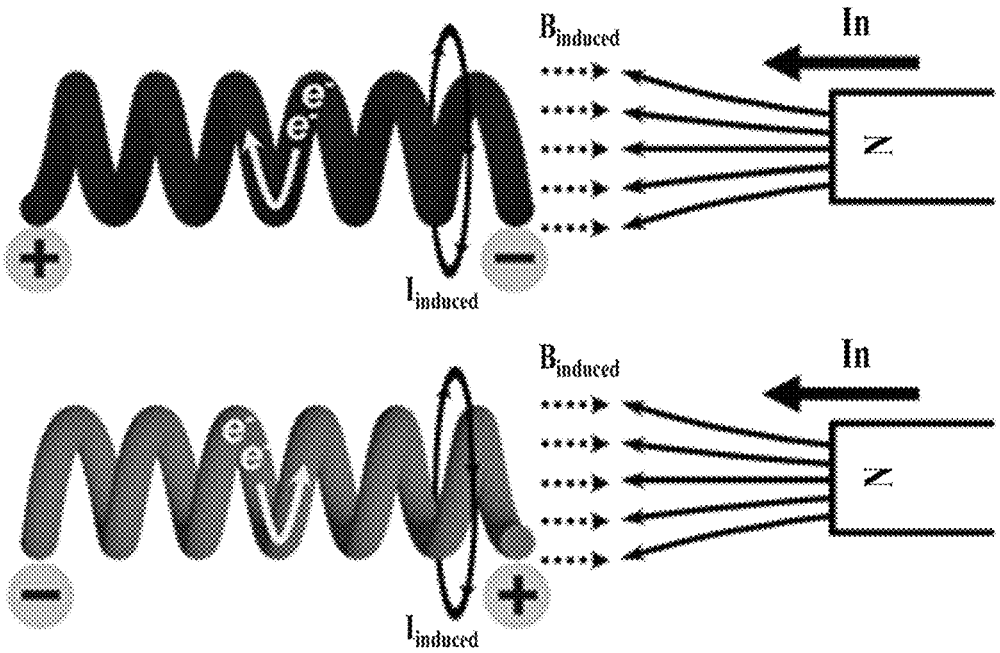
FIGS. 2A to 2C illustrate an embodiment in which magnetic nanocoils having chirality in first and second orientations by adding cinchonine and cinchonidine, respectively, are electromagnetically induced to have opposite potentials under a change in an external magnetic field.
Figure 2B:
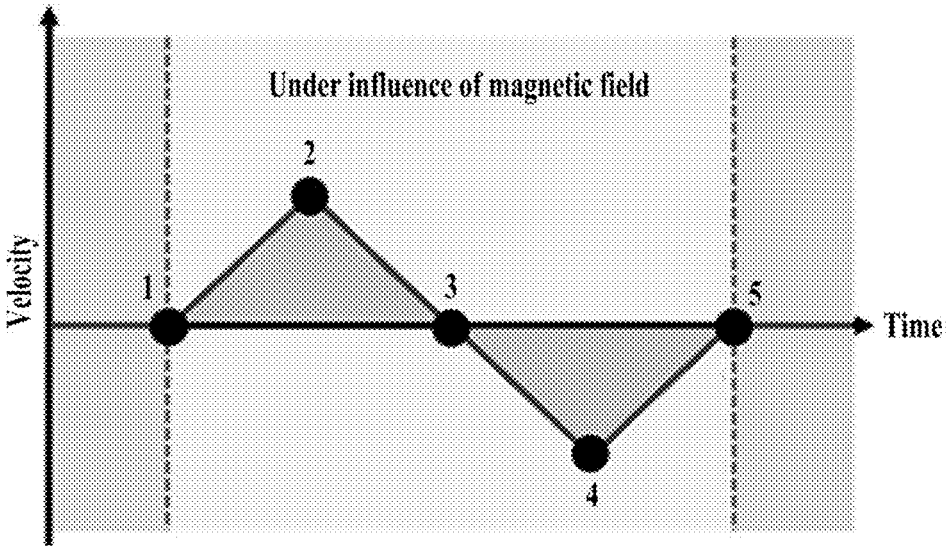
Figure 2C:
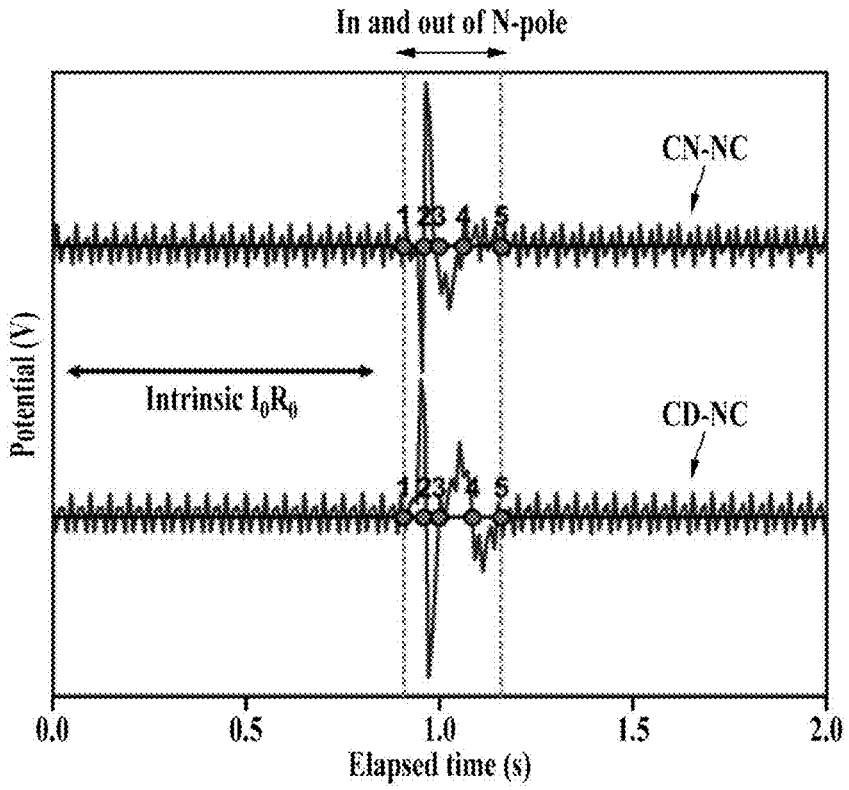

In particular, FIGS. 2A to 2C illustrate an embodiment in which magnetic nanocoils having first- and second-orientation chirality by adding cinchonine and cinchonidine, respectively, are electromagnetically induced to have opposite potentials under a change in an external magnetic field.

Figure 2D:
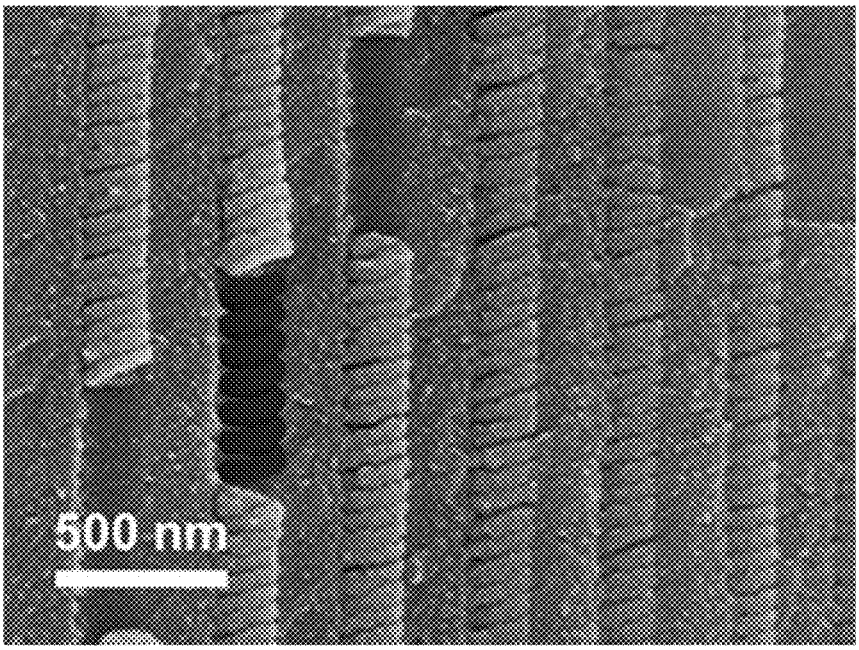
FIGS. 2D and 2G show scanning electron micrographs of nanocoils formed upon addition of respective chiral molecules.
Figure 2E:
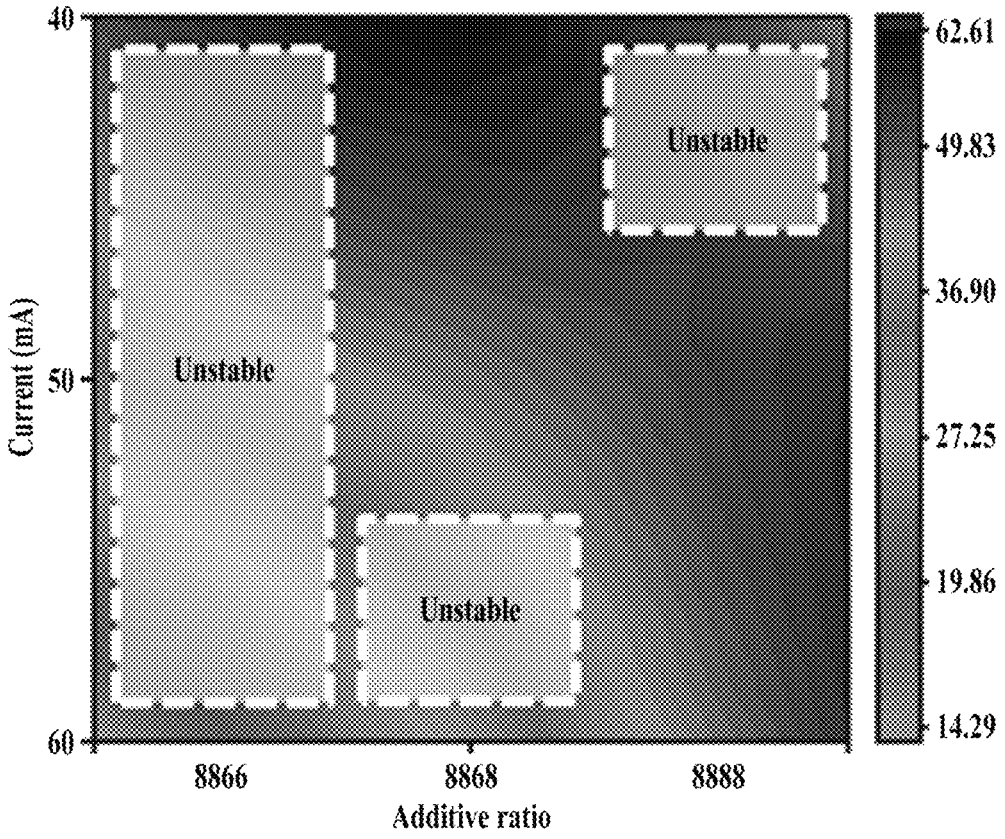
FIGS. 2E and 2H show triaxial color maps illustrating chiral bias under each condition with adjusted current density and additive concentration ratios.
Figure 2F:
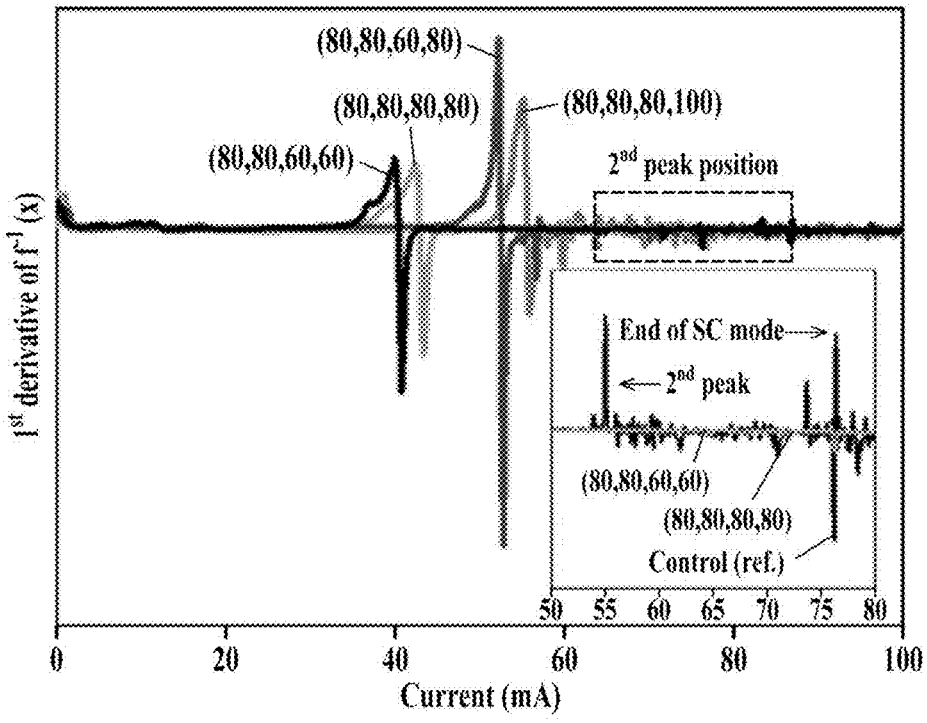
FIGS. 2F and 2I depict first order derivatives of the inverse function of a linear sweep amperometry (LSA) graph.
Figure 2G:
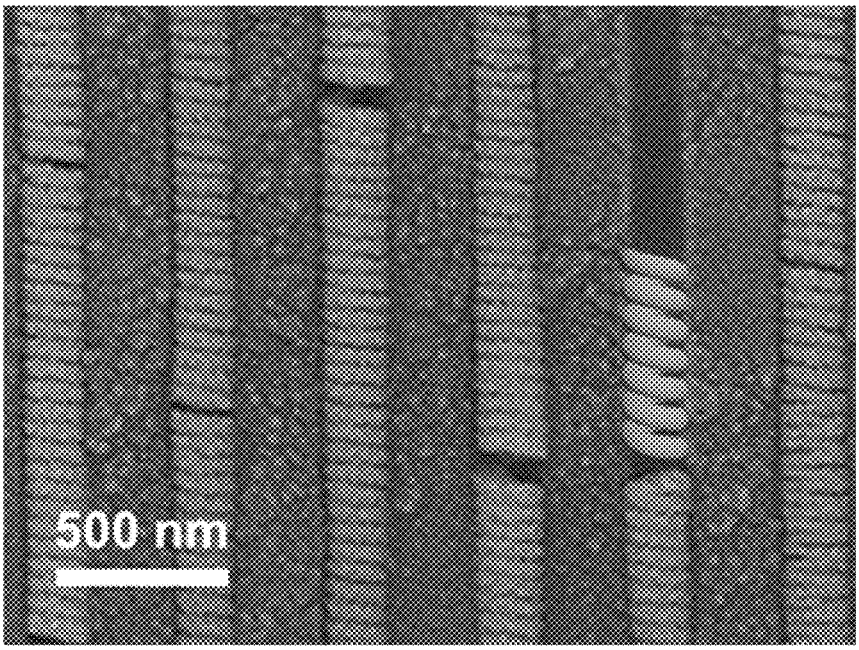

FIGS. 2D and 2G illustrate scanning electron micrographs of nanocoils formed upon addition of respective chiral molecules.

Figure 2H:
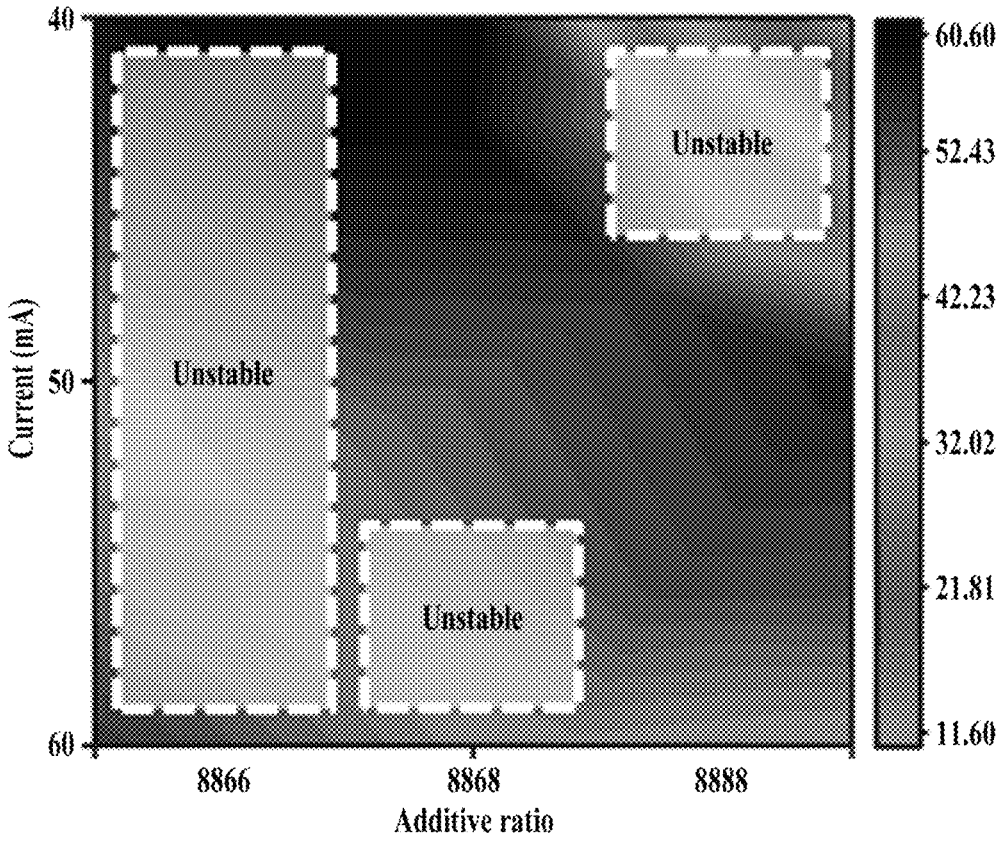

FIGS. 2E and 2H show triaxial color maps illustrating chiral bias under each condition with adjusted current density and additive concentration ratios.

Figure 2I:
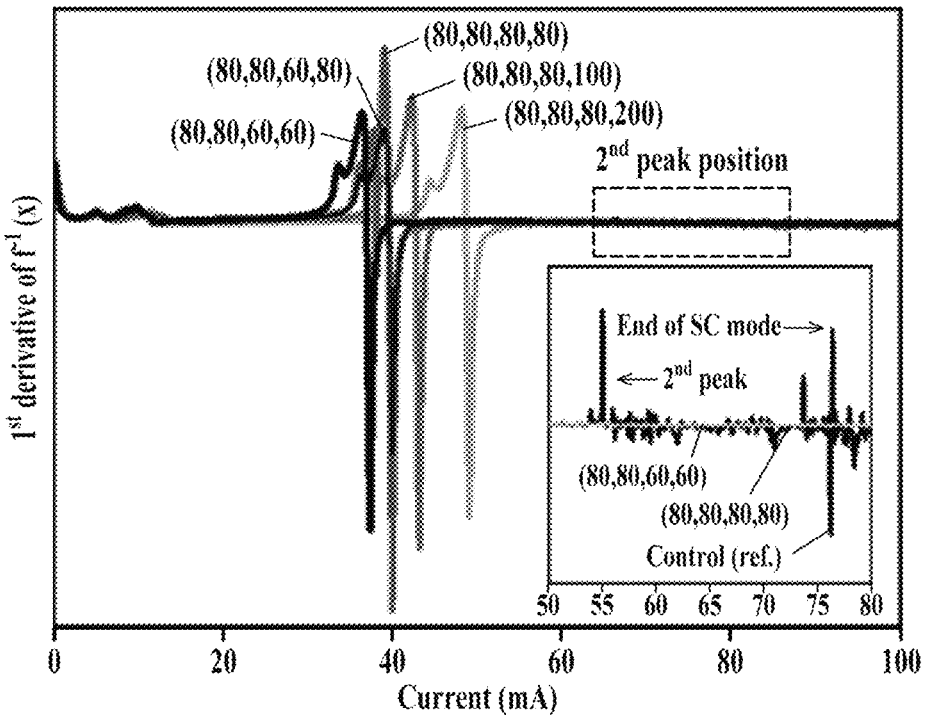
Figure 3A:
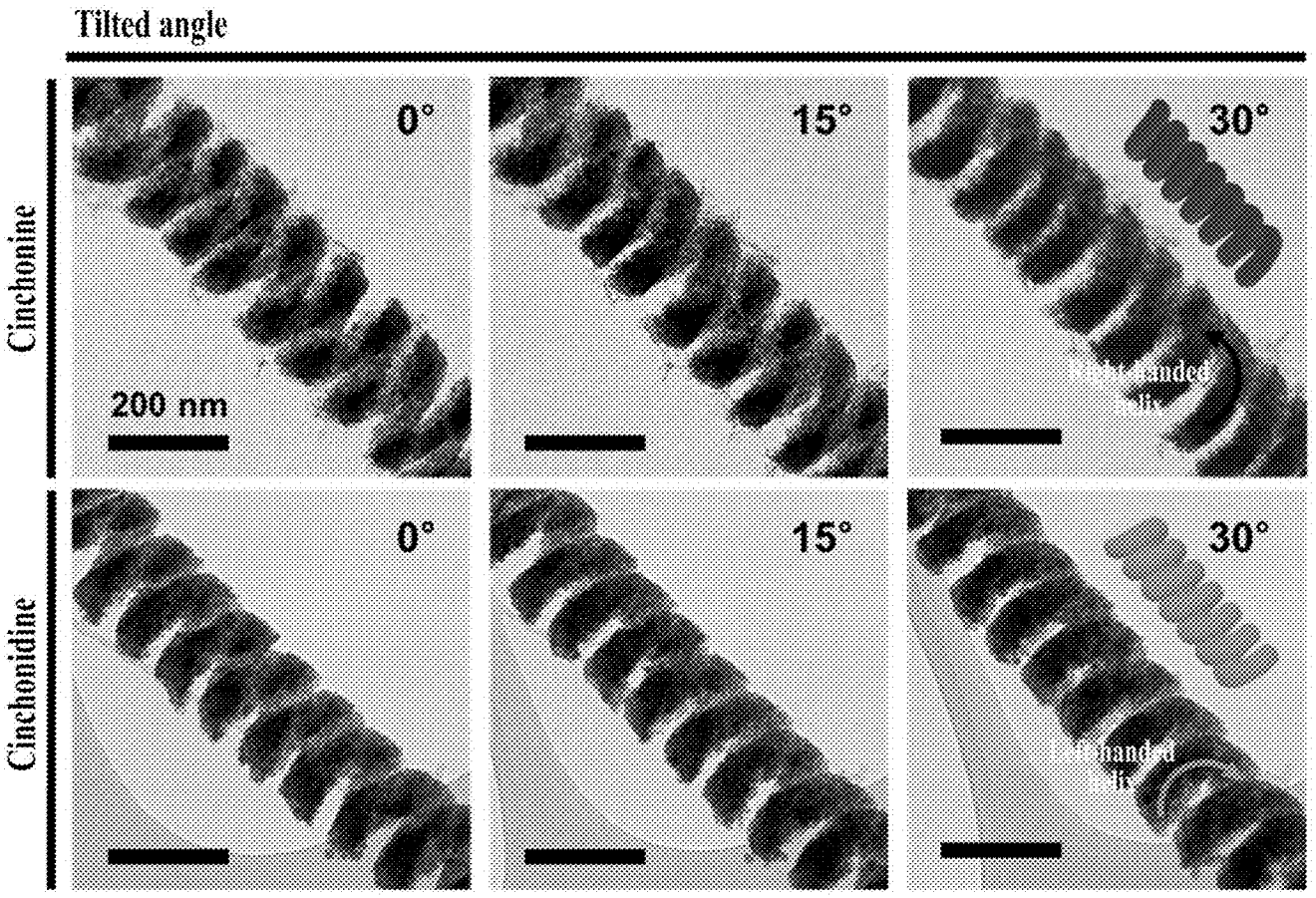
FIGS. 3A to 3F include transmission electron micrographs of chiral magnetic nanocoils, X-ray diffraction spectra, a high-resolution transmission electron micrograph and scanning transmission electron micrograph of a primary particle, an electron diffraction pattern, and a graph depicting a decrease in the size of the primary particle with the addition of chiral molecules.
Figure 3B:
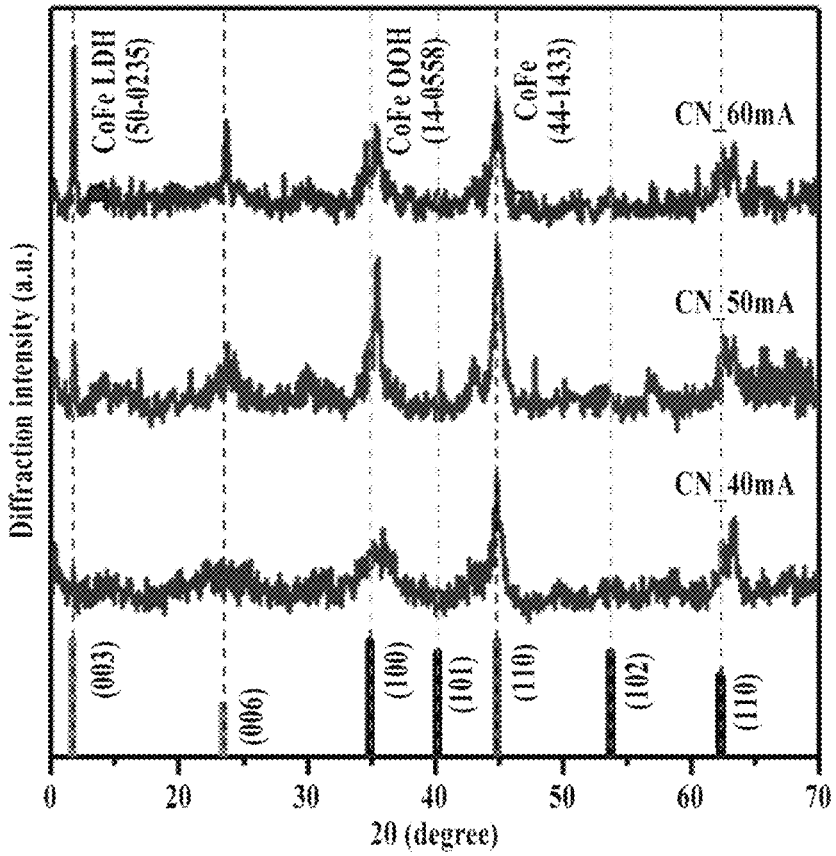
Figure 3C:
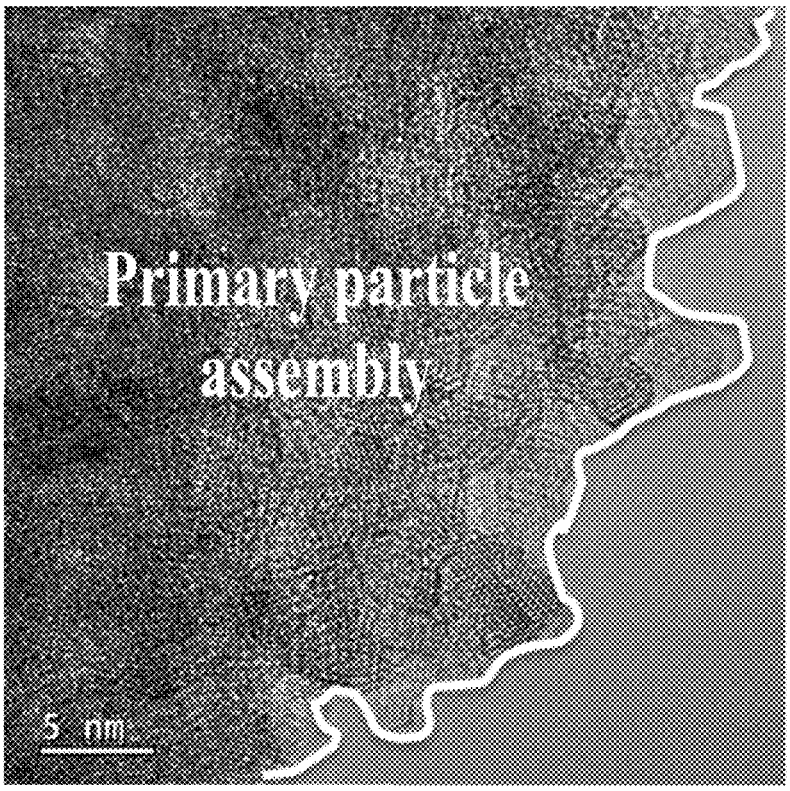
Figure 3D:
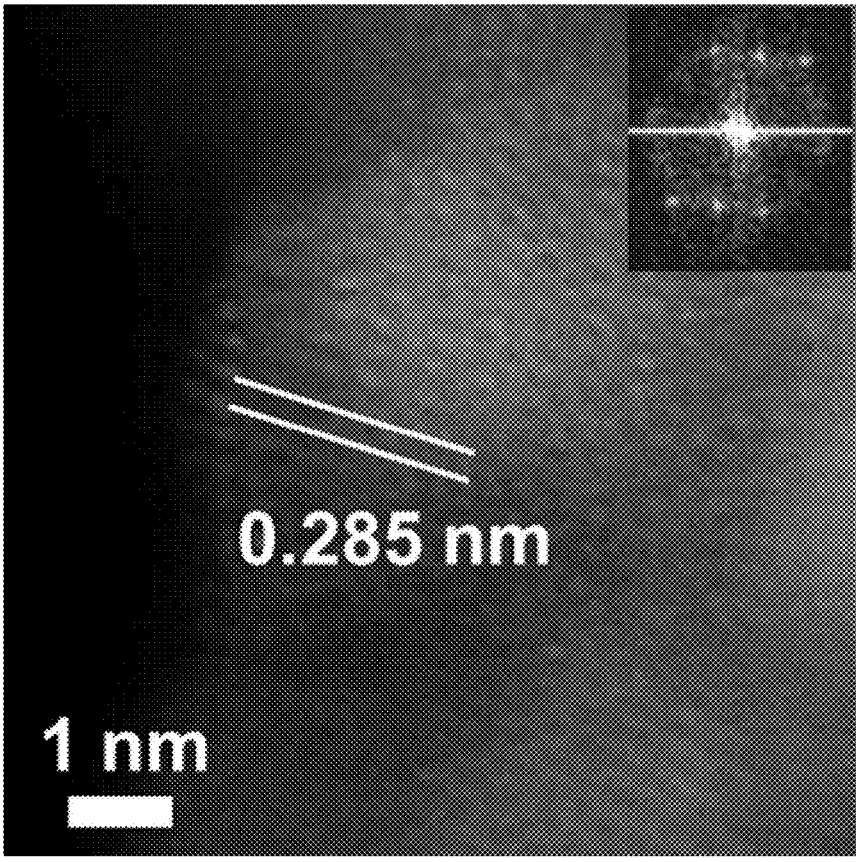
Figure 3E:
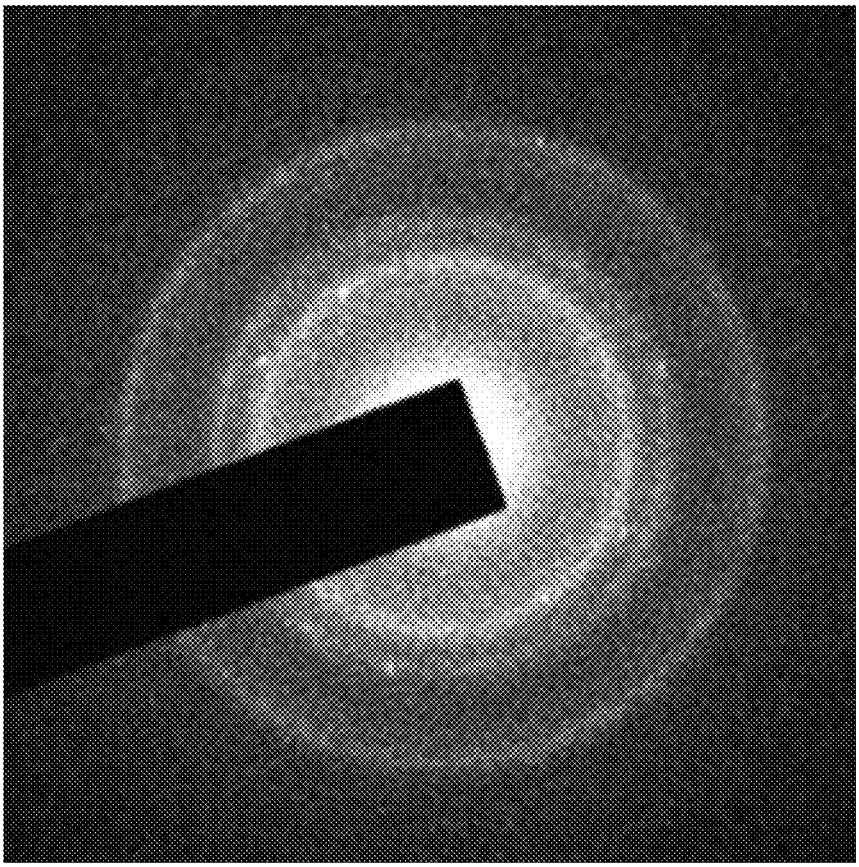
Figure 3F:
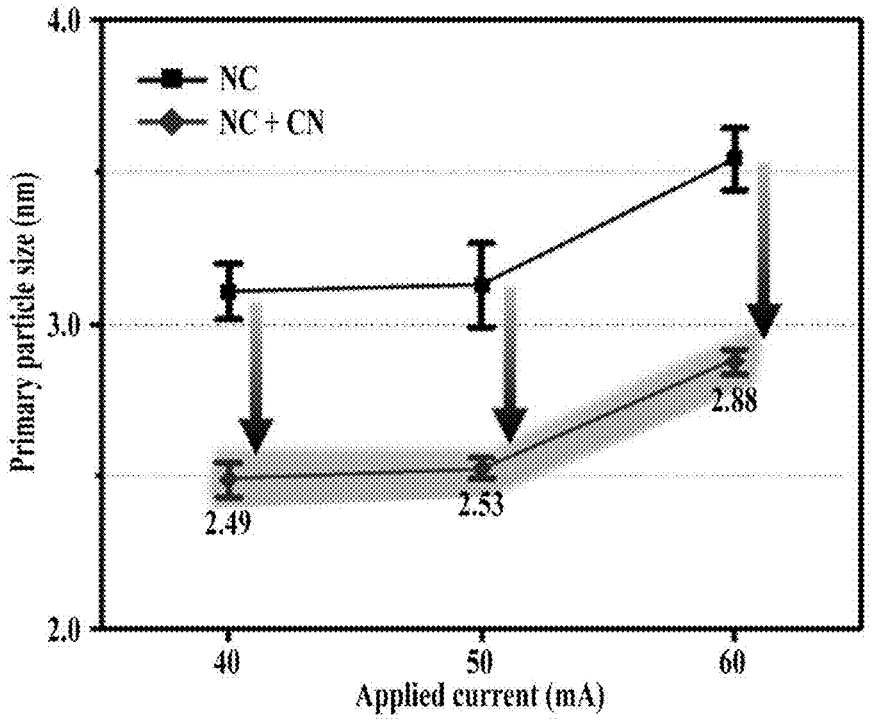

FIGS. 2F and 2I depict first order derivatives of the inverse function of a linear sweep amperometry (LSA) graph.

Chiral magnetic nanocoils may be synthesized by electrodeposition using an aluminum anodized nanopore template.

The pores are in the form of a cylindrical column with a diameter of 200 nm and a height of 60 μm, arranged in a uniform hexagonal matrix.

To synthesize the nanostructure by electrochemical method, one side of the corresponding nanopore template is coated with 300 nm thick silver (Ag) as a negative electrode by an e-beam evaporator, and a platinum (Pt) plate is used as a positive electrode.

As metal precursors, cobalt(II) sulfate heptahydrate ($Co(SO_4)_2 \cdot 7H_2O$, 80 mM) and iron(II) sulfate heptahydrate ($Fe(SO_4)_2 \cdot 7H_2O$, 80 mM) are used, and vanadium(IV) oxide sulfate hydrate ($VOSO_4 \cdot xH_2$), 60 mM) and L-ascorbic acid ($C_6H_8O_6$, 80 mM) are used as additives. Also, cinchonine hemisulfate salt ($C_{19}H_{22}N_2O \cdot ½H_2SO_4$, 0.01 mM) and cinchonidine ($C_{19}H_{22}N_2O$, 0.01 mM) are used as chiral modifiers in the first and second orientations, respectively.

After mixing the above materials, a small amount of acid may be added to adjust the pH of the solution to 1.0 to 3.0, and then the nanopore template may be filled with the mixture for electrodeposition.

After the synthesis, the negative electrode is removed with an iodine (I) series silver etchant, the nanopore template is dissolved with sodium hydroxide (NaOH), and the nanocoils that have been washed several times are dispersed in ethanol ($C_2H_6O$).

FIGS. 2A to 2C illustrate that magnetic nanocoils having chirality in first and second orientations by adding cinchonine and cinchonidine, respectively, are electromagnetically induced to have opposite potentials under a change in an external magnetic field, and FIGS. 2D and 2G show scanning electron micrographs of nanocoils formed upon addition of respective chiral molecules.

Also, FIGS. 2E and 2H show triaxial color maps illustrating chiral bias under each condition with adjusted current density and additive concentration ratios, and FIGS. 2F and 2I depict first order derivatives of the inverse function of a linear sweep amperometry (LSA) graph.

The first peak in the first derivative of the LSA graph indicates the occurrence of the surface conduction mode. Without this peak, synthesis into the coil shape is not possible.

The second peak, which occurs at applied current above 50 mA, serves as an indicator of the possibility of synthesis in the same crystal orientation when assembly between primary particles occurs, and it disappears completely with the addition of cinchonine/cinchonidine, unlike in the control sample.

These chiral modifier (chiral-forming molecules, 0.01 mM) are about 1 in 100,000 of the helical modifier (helical shaping molecules, 80 mM) in the solution, which means that a very small amount of cinchonine/cinchonidine is sufficient to randomize the assembly direction of the primary particles.

In other words, from the disappearance of the second peak in the first derivative of LSA graph, it can be inferred that chiral molecules play a specific role in controlling the assembly direction on the primary particle surface.

FIGS. 3A to 3F illustrate embodiments of analyzing the microstructure of chiral magnetic nanocoils.

In particular, FIGS. 3A to 3F include transmission electron micrographs of chiral magnetic nanocoils, X-ray diffraction spectra, a high-resolution transmission electron micrograph and scanning transmission electron micrograph of a primary particle, an electron diffraction pattern, and a graph depicting a decrease in the size of the primary particle with the addition of chiral molecules.

In the case of transmission electron microscopy, it is difficult to recognize the direction of orientation of the nanocoil because the result of the 2D projection is measured. Therefore, the chiral orientation of the coil can be checked by tilting the microscope to 30°.

This shows that the nanocoils rotate to the first orientation when cinchonine is added and to the second orientation when cinchonidine is added, as shown in the scanning electron micrograph.

By obtaining the X-ray diffraction pattern of the above sample, it can be observed that a cobalt iron hydroxide phase is present. This suggests that the hydroxy groups generated by the reduction of nitrate ions in the liquid are having an influence in the presence of relatively unreduced metal ions, and is indirect evidence that the cinchonine/cinchonidine is preventing the additional reduction of metal ions on the primary particle surface.

This can actually be confirmed by the decrease in the primary particle size in the high-resolution transmission electron micrographs over the entire range of applied currents.

Figure 4:
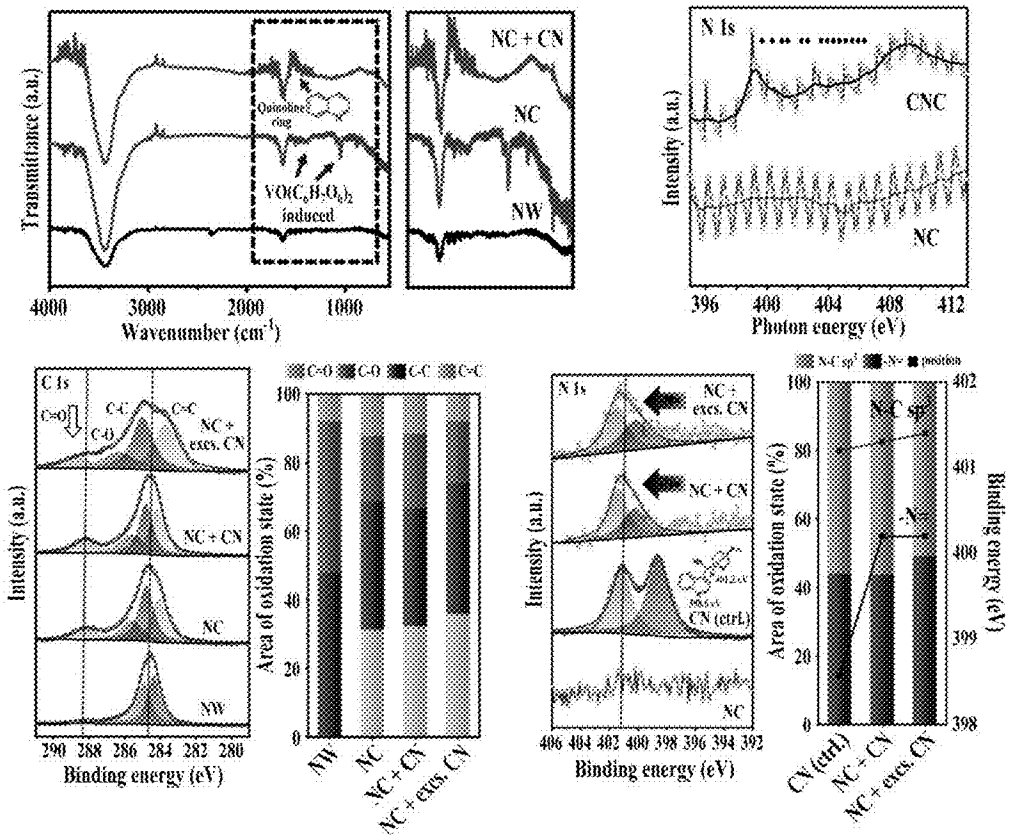
FIG. 4 shows results of Fourier transform infrared (FTIR) spectroscopy, near edge X-ray absorption fine structure (NEXAFS) spectroscopy, and X-ray photoelectron spectroscopy (XPS)

FIG. 4 shows results of Fourier transform infrared (FTIR) spectroscopy, near edge X-ray absorption fine structure (NEXAFS) spectroscopy, and X-ray photoelectron spectroscopy (XPS).

As shown in FIG. 4, the only molecules containing nitrogen (N) among the chemicals used in the chiral magnetic nanocoil manufacturing process are cinchonine and cinchonidine, which are used as chiral modifiers. By detecting them in the nanostructure with various analytical methods, it can be confirmed that the chiral molecules are actually functioning during the synthesis of chiral nanocoils and that they are adsorbed on the surface of the nanostructure.

For FTIR analysis, nanowires without any helical modifier, nanocoils with only helical modifier, and chiral nanocoils with chiral modifiers were measured, respectively. With the addition of the chiral modifiers, the peak caused by the helical modifier was significantly reduced, while sharp fluctuations and destabilization between the other peaks were observed.

This implies that even cinchonine/cinchonidine at about 1/10000 level is preferentially adsorbed on the primary particle surface over the helical modifier to the extent that it significantly affects the microstructure.

For the XPS analysis, the vicinity of C 1s and N 1s of the nanostructure containing wire, coil, chiral coil, and excess chiral modifiers were measured. The helical modifier has a C═C bond, and clearly has a C═O bond, which are absent in the chiral modifier.

These two bonds are not found in the nanowires, whereas the peaks due to these bonds begin to appear in the coil shape.

Here, when chiral modifiers are further added, it can be seen that the proportion of C═O bonds decreases, which is the difference from the helical modifier.

This may suggest that the chiral modifiers are acting inside the nanostructure during the formation of chiral nanocoils.

Furthermore, considering that only the chiral modifiers have N in synthesis reactions, the observation of N in both NEXAFS and XPS analyses suggests that cinchonine/cinchonidine contributes to chirality of the nanocoils.

First, it was successfully observed through NEXAFS analysis that a small amount of N is present, and it was also found by the XPS analysis that an N peak was generated upon the addition of cinchonine.

The N 1s can be decomposed into two peaks by the quinuclidine (N—C $sp^3$ bond) or the quinoline ring (—N=) of cinchonine.

As cinchonine was adsorbed onto the metal nanostructure, the peak caused by the quinoline ring was found to shift towards the higher binding energy region compared to the control sample.

This is because the unshared electron pair of N in the quinoline ring coordinationally bonds with the metal ion.

Figure 6:
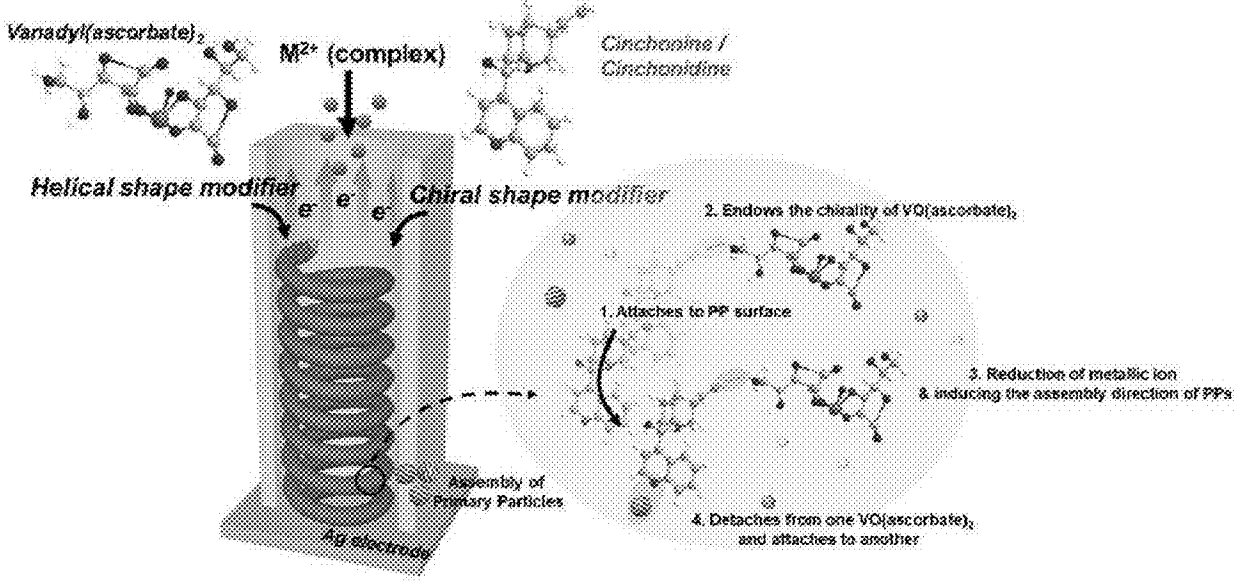
FIG. 6 is a diagram illustrating the mechanism of how the addition of cinchonine/cinchonidine influences the synthesis process.

FIG. 6 is a diagram illustrating the mechanism of how the addition of cinchonine/cinchonidine influences the synthesis process.

Considering the results corresponding to FIG. 4, the mechanism of formation of chiral nanocoils when cinchonine/cinchonidine is added to the nanostructure as shown in FIG. 6 is configured as follows.

First, when the requirements for surface conduction to occur are met, the helical modifier vanadyl ascorbate serves to generate primary particles while appropriately hindering the reduction of metal ions.

The metal surface then preferentially forms coordination bonds with the nitrogen of the quinoline ring present in the chiral modifier. The chiral modifier has a broad molecular structure from side to side, around the chiral center, which allows for a weak van der Waals force bond with a long methyl group on one side of the vanadyl ascorbate.

In this way, the orientation of the helical modifier may be induced, and the induced helical modifier helps to set the assembly direction of the next primary particle, resulting in the nanocoil having chirality.

Figure 5:
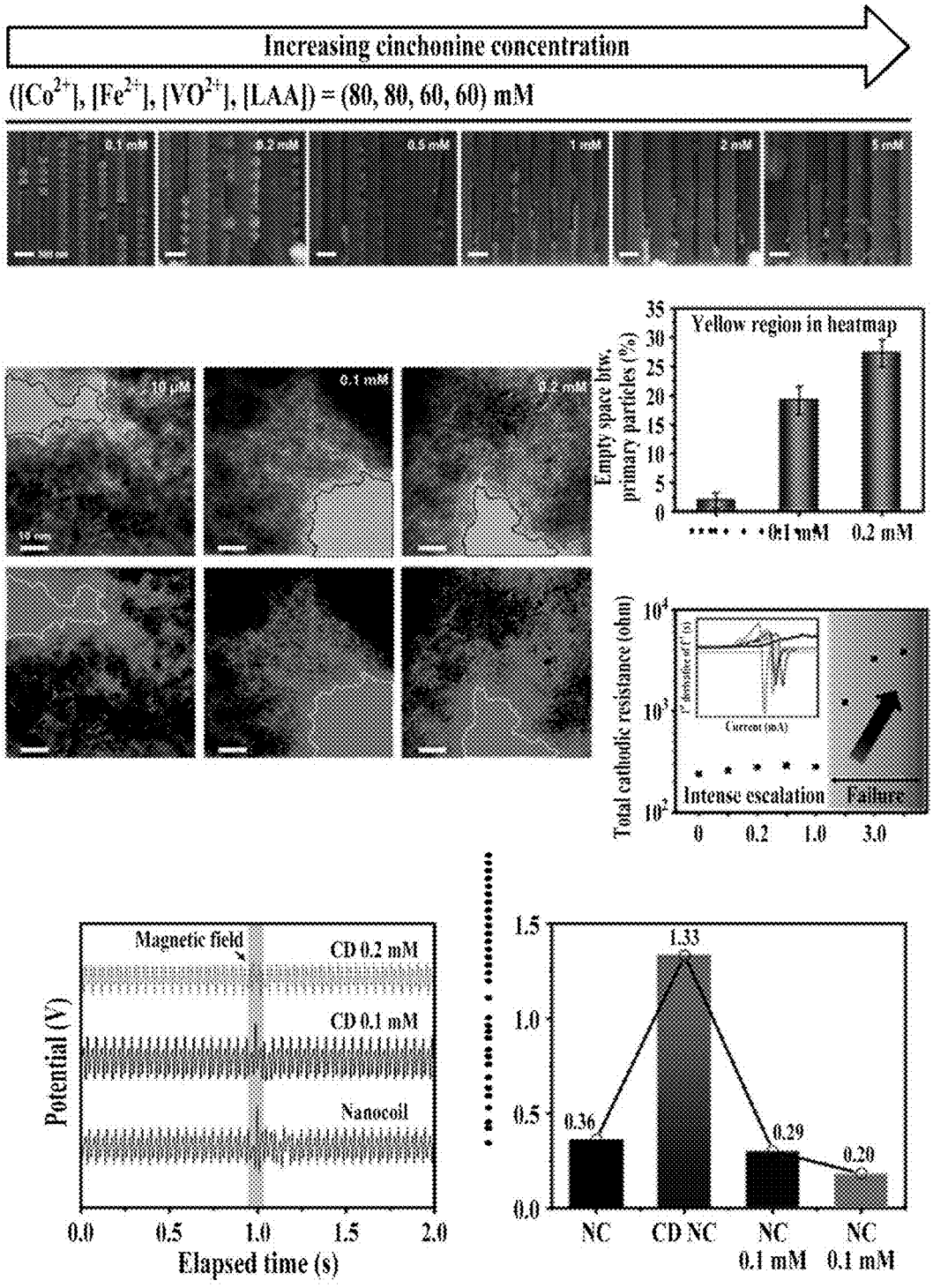
FIG. 5 shows a scanning electron micrographs, high-resolution transmission electron micrographs and heat maps, heat map color ratio and ion reduction resistance graphs, and potential graphs under a change in external magnetic field in response to an excess of the above-mentioned cinchonine and cinchonidine.

FIG. 5 shows the effect of the chiral modifier concentration and the scanning electron microscopy observation of the change in the shape of the nanostructure when cinchonine/cinchonidine is added in excess of the optimal concentration (0.01 mM) for manufacturing chiral magnetic nanocoils.

The electrical resistance during reduction increased by 10 times when the concentration of the chiral modifiers exceeded 2 mM. Since the electrical resistance in the electrolyte is related to the rate of oxidation-reduction reaction of ions, including metal ions dissolved on the electrode surface, this change implies that another mechanism may be at work in the metal ion reduction process. From this time on, all nanostructure syntheses were observed to fail.

Furthermore, high-resolution transmission electron microscopy showed that the gaps between the primary particles forming the nanocoil were widening as the chiral molecules were added in excess.

According to the heat map analysis, it can be considered that the excess of cinchonine relative to the chiral nanocoil is excessively attached to the surface of the primary particle, resulting in this measured void space.

In other words, too much cinchonine on the surface of the primary particle interferes with the reduction of the next metal ion, which can be considered to be consistent with the sharp increase in electrical resistance during reduction mentioned above.

Furthermore, potentials can be observed under a change in external magnetic field for nanostructures with 0, 0.01, 0.1, and 0.2 mM of chiral molecules added during synthesis.

In the absence of chiral shape molecules, a very low level of electromotive force may be generated compared to the chiral nanocoil (0.01 mM) shown in FIG. 2. This is because the orientation of the nanostructure is not determined and the chirality is random and thus the electromotive forces can cancel each other out. On the other hand, an excessive amount of molecules may start to break down the shape of the nanostructure, reducing its electromotive force.

FIG. 5 shows a scanning electron micrographs, high-resolution transmission electron micrographs and heat maps, heat map color ratio and ion reduction resistance graphs, and potential graphs under a change in external magnetic field in response to an excess of the above-mentioned cinchonine and cinchonidine.

Figure 7:
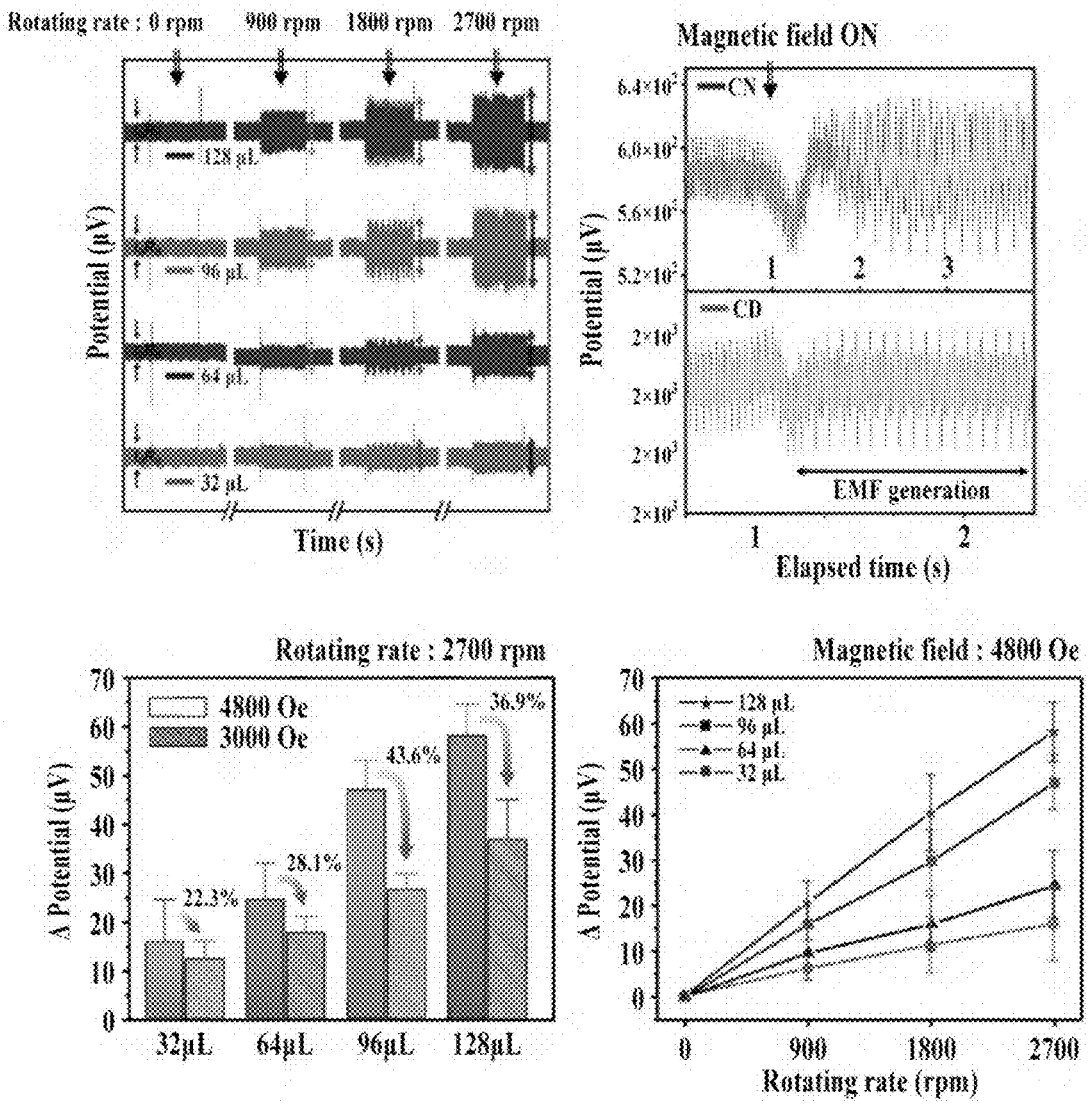
FIG. 7 depicts that nanocoils with chirality in first and second orientations exhibit electromotive force signals in opposite directions under various experimental conditions.

In other words, FIG. 7 illustrates an embodiment of electromotive force generation inside a rotating magnetic field.

Faraday's law of electromagnetic induction describes the phenomenon that a coil generates an electromotive force (emf) in response to an external magnetic flux that changes over time.

In FIG. 7, Faraday's law of electromagnetic induction can be observed at the nanoscale according to the geometric uniqueness of chiral magnetic nanocoils.

Nanocoils with the same chirality were mixed in a Vulcan carbon+Isopropyl alcohol (IPA) solution and inked, then aligned on a rotating ring disk electrode (RRDE).

FIG. 7 depicts that nanocoils with chirality in first and second orientations exhibit electromotive force signals in opposite directions under various experimental conditions.

As shown in FIG. 7, nanocoils with first-orientation and second-orientation chirality may exhibit opposite electromotive force signals.

By quantifying the emf signals obtained differently depending on the concentration of the nanocoils, the revolutions per minute (rpm) of the rotating ring disk electrode, and the strength of the applied external magnetic field, it was found that chiral magnetic nanocoils are indeed electromagnetically induced at the nanoscale in response to changes in the external magnetic field. This result is direct evidence that the chiral nanocoils can act in response to the stimulus of an external magnetic field. Also, the chiral nanocoils have great potential for future applications in spintronics devices.

Therefore, according to the present disclosure, chiral magnetic nanocoils that can be applied to various materials may be mass-produced using electrodeposition, which provides ease of synthesis and high stability, and is economical, environmentally friendly, and advantageous for large-scale synthesis.

If metal nanocoils are included, such as chiral magnetic nanocoils, they can be aligned in one direction using an external magnetic field, mixed with conductive materials to ink them, and then microelectromotive force may be measured by applying a changing magnetic field to the ink.

In addition, coil-shaped metal nanocoils may be utilized to generate microelectromotive force.

As is apparent from the above description, according to one embodiment, chiral magnetic nanocoils that can be applied to various materials may be mass-produced using electrodeposition, which provides ease of synthesis and high stability, and is economical, environmentally friendly, and advantageous for large-scale synthesis.

As disclosed above, the embodiments have been described by limited drawings. However, those skilled in the art will appreciate that various modifications and variations can be made to the present disclosure based on the above description. For example, the described techniques may be carried out in an order different from the method described, and/or components of the described system, structure, apparatus, circuit, and the like may be coupled or combined in a different form than the method described, or replaced or substituted by other components or equivalents that may achieve appropriate results.

Therefore, other implementations, other embodiments, and equivalents of the claims are within the scope of the accompanying claims.

What is claimed is:

1. A chiral magnetic nanocoil synthesized using electroplating comprising:

a primary particle generated with metal ions by applying an external electric field; and a chiral molecule bound to a surface of the generated primary particle, the chiral molecule having a chiral modifier of a first direction or a chiral modifier of a second direction opposite to the first direction, wherein the chiral molecule is bound to the surface of the generated primary particle by binding cinchonine as a chiral inducer of the first direction or by binding cinchonidine as a chiral inducer of the second direction opposite to the first direction, such that the chiral magnetic nanocoil exhibits a structural directionality corresponding to the first direction or the second direction.

2. The chiral magnetic nanocoil of claim 1, wherein an influence of the chiral molecule is controlled by adjusting at least one of an intensity of the external electric field, a concentration of metal ion precursors and the helical modifier, or a concentration of the chiral molecule.

3. The chiral magnetic nanocoil of claim 1, wherein the cinchonine is bound as the chiral modifier of the first direction by binding $C_{19}H_{22}N_2O \cdot \frac{1}{2}H_2SO_4$ of a concentration within a selected range as the chiral modifier of the first direction.

4. The chiral magnetic nanocoil of claim 3, wherein the cinchonidine is bound as the chiral modifier of the second direction by binding $C_{19}H_{22}N_2O$ of a concentration within a selected range as the chiral modifier of the second direction.

5. The chiral magnetic nanocoil of claim 4, wherein a concentration of the chiral modifier is designed taking into account a volume ratio of an anodic aluminum oxide (AAO) template and a concentration of the metal ions.

6. The chiral magnetic nanocoil of claim 5, wherein, when the AAO template is within a range of 70 to 300 nm in diameter and 10 to 100 μm in height, the chiral magnetic nanocoil is synthesized by adjusting the concentration of the metal ions and the chiral modifier in a precursor solution to a selected ratio.

7. The chiral magnetic nanocoil of claim 5, wherein, when the concentration of the metal ions is 50-200 mM based on the AAO template having a size of one nanopore of 200 nm in diameter and 60 μm in height, the concentration of the chiral modifier of the first direction or the second direction is designed in a range of [helical modifier]:[chiral modifier] =60-80 mM: 5-50 μM (1200-16000:1).

8. The chiral magnetic nanocoil of claim 1, wherein, after adding the chiral modifier of the first direction or the chiral modifier of the second direction to a solution containing a metal precursor and the helical modifier, a small amount of acid is added to adjust pH of the solution to 1.0 to 3.0, and then a nanopore template is filled and electrodeposited with the solution.

9. A method of synthesizing the chiral magnetic nanocoil of claim 1, the method comprising:

generating the primary particle composed of metal ions by applying an external electric field;

binding the chiral molecular to a surface of the generated primary particle; and controlling an assembly direction of a next primary particle or an orientation of another shaping molecule by the bound chiral molecule.

10. A nanopart comprising the chiral magnetic nanocoil of claim 1.

* * * * *